United States Patent [19]

Goloff

[11] 4,178,725

[45] Dec. 18, 1979

[54] ROTARY ENGINE HOUSING MANUFACTURE

[75] Inventor: Alexander Goloff, East Peoria, Ill.

[73] Assignee: Caterpillar Tractor Co., Peoria, Ill.

[21] Appl. No.: 897,636

[22] Filed: Apr. 17, 1978

Related U.S. Application Data

[62] Division of Ser. No. 611,100, Sep. 8, 1975, abandoned.

[51] Int. Cl.[2] ..... B24B 1/00; B24D 11/00

[52] U.S. Cl. ..... 51/290; 51/401

[58] Field of Search ..... 51/DIG. 32, 290, 281 P, 51/62, 401, 394, 206 NF; 92/169; 123/193 C

[56] References Cited

U.S. PATENT DOCUMENTS

| | | | |
|---|---|---|---|
| 2,434,880 | 1/1948 | Bramberry | 51/290 |
| 2,577,818 | 12/1951 | Shaw | 51/290 |
| 2,671,297 | 3/1954 | Arms | 51/59 R X |
| 3,384,915 | 5/1968 | Rands | 51/334 X |
| 3,871,139 | 3/1975 | Rands | 51/334 |
| 3,880,955 | 5/1974 | Hamada | 123/193 C |
| 3,922,819 | 12/1975 | Bender | 51/DIG. 32 |
| 3,961,104 | 6/1976 | Tanner | 51/290 X |

FOREIGN PATENT DOCUMENTS

| | | | |
|---|---|---|---|
| 1133041 | 11/1956 | France | 92/169 |

OTHER PUBLICATIONS

"Cylinder Boring, Honing and Wall Finishing", Brush Research Manufacturing Co., Los Angeles, Calif., 1/1976.

*Primary Examiner*—Gary L. Smith

*Attorney, Agent, or Firm*—Wegner, Stellman, McCord, Wiles & Wood

[57] ABSTRACT

A rotary engine housing having an improved inner surface structure for preventing scuffing and wear such as during break-in and heavy load operation of the engine. The housing is defined by a wall having an inner surface provided with a crosshatch topography. The cross-hatching lines are preferably arranged at a substantial angle to the line of intersection of a plane perpendicular to the axis of the piston chamber and the wall surface.

9 Claims, 4 Drawing Figures

ROTARY ENGINE HOUSING MANUFACTURE

This is a division of application Ser. No. 611,100 filed Sept. 8, 1975 now abandoned.

BACKGROUND OF THE INVENTION

1. Field of the Invention

This invention relates to rotary engines and in particular to housing constructions for use in rotary engines.

2. Description of the Prior Art

In a rotary engine, the piston rotates within a chamber defined by a housing. The housing may be selectively a center housing, an end housing, etc., and may be of the trochoidal type, slant axis type, or other conventional rotary engine type, as desired. Such housings conventionally comprise a wall having an inner surface which is engaged by the sealing means of the piston. Examples of such rotary engine construction are shown in U.S. Pat. Nos. 3,289,649 of Heinz Lamm for a Rotary Piston Engine and 3,318,515 of Charles Jones for a Wear Resistant Construction For Rotary Mechanisms.

In such rotary engines as shown in said patents, scuffing may occur as a result of the roughness of the inner surface of the center housing wall. The Lamm patent is directed to providing a resin material in the pores of the housing inner surface for extending the useful life of the engine. More specifically, Lamm teaches the use of a phenolic resin and suggests the inclusion in the resin of lubricating material, such as graphite, molybdenum, etc.

Jones attempts to increase the useful life of the engine by providing on the inner surface of the center housing wall a relatively thin layer of a carbide composition which is preferably flame-sprayed thereonto. The preferred compounds are tungsten carbide and titanium carbide, and the spray technique preferably comprises a detonation-gun flame-spraying operation. The seal member in Jones is preferably primarily iron.

SUMMARY OF THE INVENTION

The present invention comprehends an improved rotary engine housing construction wherein the inner surface of the housing wall is provided with an improved topography for effectively preventing scuffing and substantially extending the useful life of the engine.

More specifically, the present invention comprehends providing a crosshatched surface topography at the wear surface of the center housing of the rotary engine. The use of crosshatched cylinder surfaces in reciprocating engines has not been utilized in the rotary engine art, but rather, the housing construction has been such that the seals of the piston are caused to travel in the direction of the machining marks of the housing inner surface and recourse has been had to resin coating and flame-spray coating in an effort to solve the wear problem.

The present invention comprehends providing a crosshatched surface topography wherein the angle of the cross-hatching relative to the direction of movement of the piston seal thereagainst is substantially greater than zero and is preferably within the range of 45 to 80 degrees therefrom.

The surface finish of the crosshatched surface is preferably in the range of 2 to 20 microinches rms.

Crosshatch machining marks may be continuous or interrupted, as desired.

The invention comprehends generating the desired surface topography by suitable means, such as rigid grinding wheel means, movable stone hones, etc. The invention comprehends an improved method of providing such topography utilizing a flexible hone. The hone may comprise an inflatable boot and may have rigid longitudinal stays extending in a direction parallel to the axis of the piston chamber.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
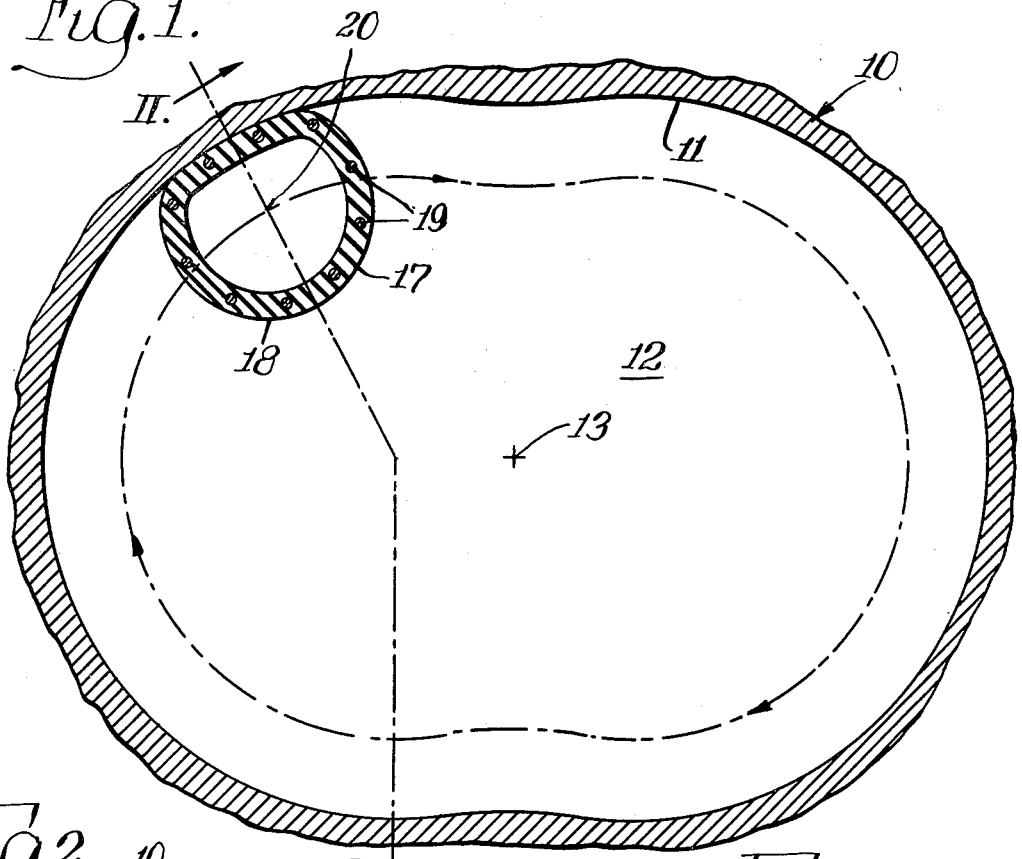
FIG. 1 is a cross section of a center housing defining a piston chamber embodying the invention illustrating one method of providing the improved surface topography embodying the invention.

In the exemplary embodiment of the invention as disclosed in the drawing, a center housing generally designated 10 of a rotary internal combustion engine is shown to comprise a wall means having an inner surface 11 defining a piston chamber 12 and extending about an axis 13. The invention comprehends an improved topography of the surface 11 providing improved long life with minimized scuffing of the seal during operation of the engine. The center housing 10 may be utilized in any desired form of rotary engine including those of the trochoidal, slant axis, etc., types.

Figure 3:
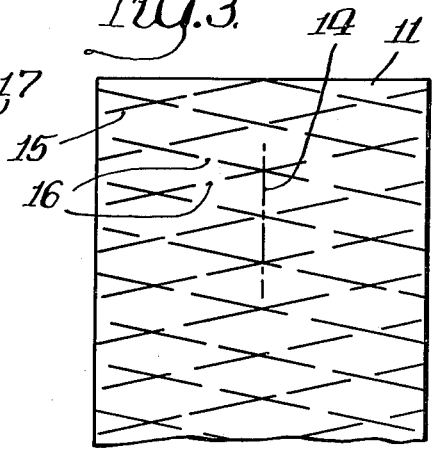
FIG. 3 is a developed view of the inner surface topography of the housing illustrating the use of interrupted cross-hatching therein.
Figure 4:
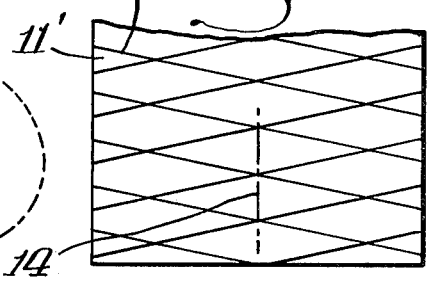
FIG. 4 is a developed view of the inner surface topography of the housing illustrating the use of continuous cross-hatching therein.

The invention comprehends providing the surface 11 with a crosshatched topography wherein the angle of the cross-hatching relative to a line 14 of intersection of a plane perpendicular of the axis 13 of the piston chamber with the surface 11, as illustrated in FIGS. 3 and 4. The angle of the cross-hatching to line 14 is preferably within the range of approximately 45 to 80 degrees. More specifically, the angle may be in the range of approximately 55 to 65 degrees.

The cross-hatching is preferably equiangularly related to the line 14 and, thus, preferably defines an included angle in the range of approximately 90 to 160 degrees, and more specifically, in the range of approximately 115 to 130 degrees.

The surface finish of surface 11 is preferably in the range of 2 to 20 microinches rms. A highly desirable surface finish is one of approximately 5 microinches rms.

As shown in FIG. 3, the cross-hatching 15 may be interrupted, such as at discontinuities 16. Alternatively, as shown in FIG. 4, the cross-hatching 15' may be substantially continuous.

Figure 2:
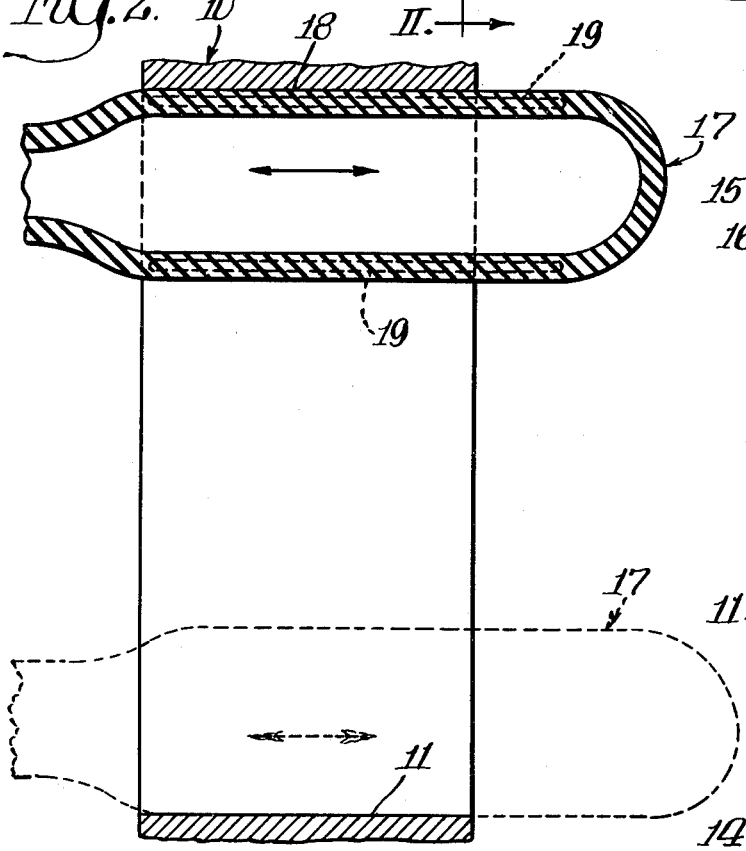
FIG. 2 is a transverse section taken substantially along the line II—II of FIG. 1.

One improved method of forming such a crosshatched surface topography of the wear surface 11 of center housing 10 is illustrated in FIGS. 1 and 2 as comprising the honing of the surface by a flexible boot 17 having an abrasive outer surface 18 of suitable grit size. The boot may be formed of any suitable flexible material, such as rubber, and may be inflated to provide controlled honing force against the surface 11.

As shown in FIGS. 1 and 2, the boot may be provided with reinforcing means 19 extending longitudinally thereof to provide increased rigidity parallel to axis 13 of piston chamber 12. The reinforcing means may comprise metallic stays or the like. In the illustrated embodiment, the stays are substantially rectilinear, it being understood that other suitable configurations, such as arcuate, etc., may be utilized within the scope of the invention. The stays preferably have a rigidity preselected to cause the hone to be axially substantially rigid and circumferentially substantially flexible whereby the stays assist in maintaining the hone flat against surface 11 during the honing operation, as shown in FIG. 2, to provide a substantially uniform cut from end to end of the center housing during the honing operation. The use of boot 17 thusly permits the provision of substantially continuous cross-hatching 15' in surface 11' illustrated in FIG. 4 for providing further improved wear characteristics.

The discontinuous cross-hatching of FIG. 3 may be provided by suitable surface finishing means, such as rigid grinding wheels, hones with one or more movable stones, etc. In the surface finishing of the center housing surface 11, the finishing means are moved back and forth parallel to the axis 13 while concurrently being rotated about the axis 20 of the hone to provide the cross-hatching topography.

As will be obvious to those skilled in the art, the relationship of the rate of oscillation and the rate of rotation may be suitably preselected to define the desired cross-hatching angle as discussed above.

The improved antiscuffing housing wear surface topography of the present invention provides extended useful life of the engine. The improved long life of the seals provided by the present invention further provides improved oil control in the engine for providing further extended useful life thereof.

The surface construction and method of forming the same of the present invention are extremely simple and economical while yet providing the highly desirable advantages discussed above.

The foregoing disclosure of specific embodiments is illustrative of the broad inventive concepts comprehended by the invention.

I claim:

1. The method of finishing a rotary internal combustion engine inner wall surface, comprising honing said wall surface to define a crosshatched topography wherein unfilled cross-hatching lines are provided at a substantial angle to the line of intersection of a transverse plane with said wall surface, said honing step being effected by a flexible cylindrical hone having rigid longitudinal reinforcing stays arranged in a coaxially annular array about the axis of the cylindrical hone whereby the hone is axially substantially rigid and circumferentially substantially flexible, said hone being rotated about said axis and concurrently oscillated parallel to said axis during the honing operation to provide a preselected substantially uniformly angled cross-hatching of the wall surface.

2. The method of finishing a rotary engine housing wall means of claim 1 wherein the angle of said cross-hatching is in the range of approximately 45 to 80 degrees.

3. The method of finishing a rotary engine housing wall means of claim 1 wherein the angle of said cross-hatching is in the range of approximately 55 to 65 degrees.

4. The method of finishing a rotary engine housing wall means of claim 1 wherein the surface finish of said inner surface is in the range of approximately 2 to 20 microinches.

5. The method of finishing a rotary engine housing wall means of claim 1 wherein the surface finish of said inner surface is approximately 5 microinches.

6. The method of finishing a rotary engine housing wall means of claim 1 wherein the cross-hatching defines lines extending equiangularly to define an intersecting angle in the range of approximately 90 to 160 degrees.

7. The method of finishing a rotary engine housing wall means of claim 1 wherein the cross-hatching defines lines extending equiangularly to define an intersecting angle in the range of approximately 115 to 130 degrees.

8. The method of finishing a rotary engine housing wall means of claim 1 wherein the cross-hatching defines lines which are substantially continuous.

9. The method of finishing a rotary engine housing wall means of claim 1 wherein the cross-hatching defines lines which are interrupted.

* * * * *